US012146206B2

(12) United States Patent
Miwa et al.

(10) Patent No.: US 12,146,206 B2
(45) Date of Patent: Nov. 19, 2024

(54) ZINC THARMAL SPLAYING MATERIAL AND METHOD FOR MANUFACTURING THE SAME AND THARMAL SPLAYING DEVICE

(71) Applicant: Nippon Telegraph and Telephone Corporation, Tokyo (JP)

(72) Inventors: Takashi Miwa, Tokyo (JP); Azusa Ishii, Tokyo (JP); Masamitsu Watanabe, Tokyo (JP); Soichi Oka, Tokyo (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 241 days.

(21) Appl. No.: 17/774,067

(22) PCT Filed: Nov. 6, 2019

(86) PCT No.: PCT/JP2019/043409
§ 371 (c)(1),
(2) Date: May 3, 2022

(87) PCT Pub. No.: WO2021/090384
PCT Pub. Date: May 14, 2021

(65) Prior Publication Data
US 2022/0380879 A1 Dec. 1, 2022

(51) Int. Cl.

| | |
|---|---|
| ***C22C 18/04*** | (2006.01) |
| ***B22F 1/12*** | (2022.01) |
| ***C23C 4/04*** | (2006.01) |
| ***C23C 4/123*** | (2016.01) |

(52) U.S. Cl.
CPC ..... *C22C 18/04* (2013.01); *B22F 1/12* (2022.01); *C23C 4/04* (2013.01); *C23C 4/123* (2016.01)

(58) Field of Classification Search
CPC ..... C23C 4/123; C23C 4/04; C22C 18/04; B22F 1/12
See application file for complete search history.

(56) References Cited

FOREIGN PATENT DOCUMENTS

JP 2007-099832 * 4/2007

OTHER PUBLICATIONS

English Abstract and English Machine Translation of Kasugai et al. (JP 2007-099832) (Apr. 19, 2007).*
N.S. Azmat et al., "Corrosion of Zn under acidified marine droplets", Corrosion Science, vol. 53, 2011, pp. 1604-1615.
(Continued)

*Primary Examiner* — Jessee R Roe
(74) *Attorney, Agent, or Firm* — Slater Matsil, LLP

(57) ABSTRACT

A zinc spraying material comprises a zinc material containing zinc; and a sulfate salt whose solubility in water is ⅛ or more of the solubility of calcium sulfate. The content of the sulfate salt in the zinc spraying material can be 0.006 to 0.14 mol based on 100 g of the content of the zinc material. Note that the sulfate salt can be at least one of potassium sulfate, sodium sulfate, magnesium sulfate, calcium sulfate, ferric sulfate, ferrous sulfate, lithium sulfate, calcium sulfate, and aluminum sulfate. Also, the zinc material is zinc. Alternatively, the zinc material can also be a zinc alloy containing zinc as the main component and at least one metal selected from aluminum and magnesium.

3 Claims, 1 Drawing Sheet

(56) References Cited

OTHER PUBLICATIONS

Galvanized Steel Structures Research Study Group, The Japan Iron and Steel Federation, "Corrosion resistance of hot dip galvanizing", "https://jlzda.gr.jp/mekki/pdf/youyuu.pdf"—retrieved on Oct. 30, 2019, 41 pages.

T. Miwa et al., "Technical Report," Various accelerated corrosion tests and outdoor exposure tests using coated steel sheets comparison of corrosion behavior, Anti-rust Management, vol. 61, No. 12, 2017, Japan, pp. 449-455.

T. Miwa, et al., "Study on Accelerated Corrosion Test Solution to Reproduce Atmospheric Corrosion of Zinc in Salt Damage Environment More Accurately", Materials and Environments 2018, May 23, 2018, B-308, pp. 193-196.

* cited by examiner

ZINC THARMAL SPLAYING MATERIAL AND METHOD FOR MANUFACTURING THE SAME AND THARMAL SPLAYING DEVICE

CROSS-REFERENCE TO RELATED APPLICATIONS

This application is a national phase entry of PCT Application No. PCT/JP2019/043409, filed on Nov. 6, 2019, which application is hereby incorporated herein by reference.

TECHNICAL FIELD

The present invention relates to a zinc spraying material, a method for producing the same, and a spraying device.

BACKGROUND

Zinc spraying is one of the methods of corrosion protection for metallic materials (mainly steel) from corrosion. The zinc spraying is a surface coating method in which zinc is melted by electric or combustion energy, and atomized and blasted by compressed air or the like to form a film. The spraying coating (zinc layer) formed on the metallic material acts as a sacrificial corrosion protection for metals nobler than zinc, even when the base metallic material is exposed due to scratches on the spraying coating. Also, zinc ions released from the spraying coating form zinc corrosion products at the exposed area, which become a protective film. In this way, zinc spraying can form a spraying coating that provides excellent corrosion protection effects due to the sacrificial corrosion protection and protective film properties of zinc. Instead of zinc, zinc alloy spraying using a zinc alloy in which aluminum or magnesium is added to zinc is also practiced, which can form a zinc alloy layer with higher corrosion protection.

SUMMARY

Technical Problem

As mentioned above, zinc spraying has excellent performance in terms of the sacrificial corrosion protection and protective film properties. However, after the formed spraying coating (zinc layer) is corroded and worn out, the sacrificial corrosion protection and protective film properties no longer work, and corrosion of the underlying metal (mainly steel) proceeds.

When the spraying coating is worn out, for example, the iron-zinc alloy layer is exposed and red rust is generated, and the corrosion further progresses to the steel substrate, it is necessary to remove the rust (substrate conditioning) and then perform repairs such as painting. Since it is desirable that outdoor steel structures having spraying coatings formed thereon should be maintenance-free for a long period of time, thicker spraying coatings are generally formed. However, even when such thick spraying coatings are formed, the iron-zinc alloy layer may be exposed and require painting in less than 10 years in a particularly harsh environment among salt damaged areas. Therefore, there is a need for a spraying coating having a longer service life.

Embodiments of the present invention have been made to solve the problem as described above, and an object thereof is to extend the service life of the coating by zinc spraying without increasing the cost.

Means for Solving the Problem

A zinc spraying material according to embodiments of the present invention comprises: a zinc material containing zinc; and a sulfate salt whose solubility in water is ⅛ or more of the solubility of calcium sulfate.

A method for producing the zinc spraying material according to embodiments of the present invention comprises: a first step of melting the zinc material; a second step of dispersing the sulfate salt into the melted zinc material; and a third step of cooling and solidifying the melted zinc material in which the sulfate salt is dispersed.

A spraying device according to embodiments of the present invention comprises: a spouting unit that heats, melts, and spouts a supplied spraying material; a first supplying unit that supplies a zinc material; a second supplying unit that supplies a sulfate salt separately from the first supplying unit; and a mixing unit that mixes the zinc material supplied by the first supplying unit and the sulfate salt supplied by the second supplying unit together immediately before the spouting unit and supplies them to the spouting unit.

Effects of Embodiments of the Invention

As described above, in the present invention, a sulfate salt whose solubility in water is ⅛ or more of the solubility of calcium sulfate is added to a zinc spraying material such that the zinc spraying material comprises a zinc material containing zinc and the sulfate salt, and therefore, the service life of the coating by zinc spraying can be extended without increasing the cost.

DETAILED DESCRIPTION OF ILLUSTRATIVE EMBODIMENTS

Hereinafter, a zinc spraying material according to an embodiment of the present invention will be described. This zinc spraying material comprises: a zinc material containing zinc; and a sulfate salt whose solubility in water is ⅛ or more of the solubility of calcium sulfate. This sulfate salt has a solubility in water of 0.0017 mol/L or more at normal temperature.

The content of the sulfate salt in the zinc spraying material can be 0.006 to 0.14 mol based on 100 g of the content of the zinc material. Note that the sulfate salt can be at least one of potassium sulfate, sodium sulfate, magnesium sulfate, calcium sulfate, ferric sulfate, ferrous sulfate, lithium sulfate, calcium sulfate, and aluminum sulfate.

Also, the zinc material is zinc. Alternatively, the zinc material can also be a zinc alloy containing zinc as the main component and at least one metal selected from aluminum and magnesium.

In addition, in the zinc spraying material, the zinc material and the sulfate salt can be mixed together, both in a state of powder.

In addition, in the zinc spraying material, the zinc material and the sulfate salt can be mixed together to be integrated. The zinc spraying material configured as described above can be produced by: first, melting the zinc material (a first step); next, dispersing the sulfate salt into the melted zinc material (a second step); and then cooling and solidifying the melted zinc material in which the sulfate salt is dispersed (a third step).

Figure 1:
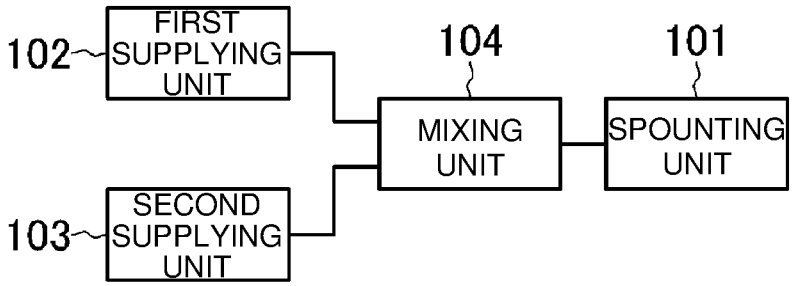
FIG. 1 is a constitutional view illustrating the configuration of a spraying device according to an embodiment of the present invention.

Here, a spraying device that forms a spraying coating using the zinc spraying material according to the embodiment will be described with reference to FIG. 1. This spraying device comprises a spouting unit 101, a first supplying unit 102, a second supplying unit 103, and a mixing unit 104.

The spouting unit 101 heats, melts, and spouts a supplied spraying material. The spouting unit 101 is, for example, a plasma spraying gun. Alternatively, the spouting unit 101 can also be a nozzle for gas flame spraying or high velocity flame spraying (high velocity gas flame spraying).

The first supplying unit 102 supplies the zinc material, and the second supplying unit 103 supplies the sulfate salt separately from the first supplying unit 102. The zinc material and the sulfate salt are both, for example, powder. The mixing unit 104 mixes the zinc material supplied by the first supplying unit 102 and the sulfate salt supplied by the second supplying unit 103 together immediately before the spouting unit 101 and supplies them to the spouting unit 101. The mixing unit 104 mixes the supplied zinc material and sulfate salt at a preset mixing ratio.

This spraying device can form a spraying coating in which the zinc material and the sulfate salt are mixed in the desired (predetermined) ratio. Gas flame spraying devices, high velocity flame spraying (high velocity gas flame spraying) devices, and plasma spraying devices can use powder materials. In spraying using these devices, zinc powder and sulfate salt powder that have been mixed in a certain ratio in advance are sprayed. However, since the specific gravities of zinc powder and sulfate salt powder are greatly different, the ratio between zinc powder and sulfate salt powder may become uneven during storage or operation in the mixed powder that has been mixed together. On the other hand, the spraying device according to the embodiment mentioned above mixes the zinc powder and sulfate salt powder, which are separately supplied through different routes, in a certain ratio immediately before spraying, and therefore, the spraying coating can be formed in a state where the ratio of the two is always constant.

Note that, for example, when an arc spraying device is used, it is not possible to use powder as the zinc spraying material. In this case, the zinc spraying material produced by the production method mentioned above, in which the zinc material and the sulfate salt have been mixed together to be integrated, can be used.

As is well known, the zinc spraying is a surface coating method in which zinc is melted by electric or combustion energy, and atomized and blasted by compressed air or the like to form a film. In embodiments of the present invention, a sulfate salt whose solubility in water is higher than ⅛ of that of calcium sulfate is added to this zinc material used for zinc spraying. The sulfate salt is an additive agent to the zinc material for reducing the wear of the spraying coating (zinc layer) and the corrosion of the base material (mainly steel) when the spraying coating is scratched.

As a countermeasure against the wear of the spraying coating due to the corrosion of zinc in the spraying coating, it is thought to reduce the corrosion rate of zinc in the spraying coating. When the corrosion rate of zinc can be reduced, the sacrificial corrosion protection and protective film properties by zinc are sustained for a long period of time. In order to reduce the corrosion rate of zinc, spraying that uses a zinc alloy in which aluminum, aluminum magnesium, or the like is added to zinc has also been carried out. However, these technologies increase the cost.

In contrast, the addition of sulfate salt can suppress the increase in cost. In addition, the addition of sulfate salt can not only reduce the corrosion rate of zinc in the spraying coating, but also produce highly protective corrosion products and suppress the corrosion of the material to be sprayed (mainly steel) in the damaged area of the spraying coating. Also, for the above-mentioned spraying technology using zinc alloy, the addition of sulfate salt can further reduce the corrosion rate of zinc in the spraying coating and further extend the service life of the coating by zinc spraying, without causing a further increase in cost.

Hereinafter, more detailed description will be given using the results of experiments.

Experiment 1

At first, Experiment 1 will be described.

Sample Preparation 1

Calcium sulfate dihydrate (special grade) (hereinafter, calcium sulfate) powder was added to commercially available zinc powder for spraying, they were mixed well, and a layer of spraying coating with a thickness of about 100 μm was formed on a steel plate (see FIG. 2) using a gas flame spraying device for powder, which was used as a sample of Experiment 1. Note that the steel plate is a rectangular plate of 70 mm×150 mm in plan view and with a thickness of 3.2 mm. The steel plate was made of a SS400 standard steel material. Also, a blast treatment has been performed on the surface of the steel plate.

Sample A is a sample prepared from a spraying material in which calcium sulfate powder has been added to zinc powder such that the amount of calcium sulfate powder added is 0 wt % of the weight of zinc powder (no addition).

Sample B is a sample prepared from a spraying material in which calcium sulfate powder has been added to zinc powder such that the amount of calcium sulfate powder added is 1 wt % of the weight of zinc powder.

Sample C is a sample prepared from a spraying material in which calcium sulfate powder has been added to zinc powder such that the amount of calcium sulfate powder added is 2 wt % of the weight of zinc powder.

Sample D is a sample prepared from a spraying material in which calcium sulfate powder has been added to zinc powder such that the amount of calcium sulfate powder added is 4 wt % of the weight of zinc powder.

Sample E is a sample prepared from a spraying material in which calcium sulfate powder has been added to zinc powder such that the amount of calcium sulfate powder added is 8 wt % of the weight of zinc powder.

Sample F is a sample prepared from a spraying material in which calcium sulfate powder has been added to zinc powder such that the amount of calcium sulfate powder added is 16 wt % of the weight of zinc powder.

Sample G is a sample prepared from a spraying material in which calcium sulfate powder has been added to zinc powder such that the amount of calcium sulfate powder added is 24 wt % of the weight of zinc powder.

Sample H is a sample prepared from a spraying material in which calcium sulfate powder has been added to zinc powder such that the amount of calcium sulfate powder added is 32 wt % of the weight of zinc powder.

Note that any spraying device may be used as long as it uses spraying materials in the form of powder, and other than the gas flame spraying device, a plasma spraying device may be used, or a high velocity gas flame spraying device may be used. Zinc powder needs to be melted at the time of spraying, but calcium sulfate does not need to be melted, and for example, it can be used as it is in the form of a powder. The temperature of zinc at the time of spraying and other conditions can be the same as normal spraying conditions for zinc.

Figure 2:
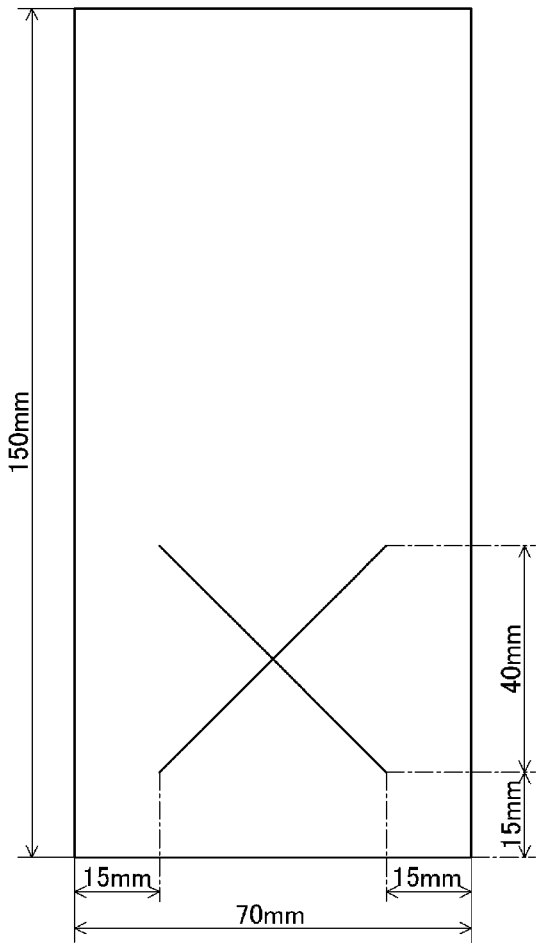
FIG. 2 is a plan view illustrating the configuration of a steel plate used for sample preparation.

After each sample was prepared by spraying, in order to evaluate the sacrificial corrosion protection and protective film properties on the part where the spraying coating (zinc layer) was scratched, for each of Samples A to H, as illustrated in FIG. 2, artificial scratches in the shape of an "X" were made on the lower half region to reach the steel material, using a small blade cutter knife, thereby preparing a "damaged area of the spraying coating".

A combined cycle test was performed on each of the samples on which the damaged area of the spraying coating had been formed, in which salt water spraying, wetting, and drying were repeated. As for the test conditions of the combined cycle test, the NTT type combined cycle test described in Reference 1 was performed for 4000 hours. However, as described in Reference 2, when zinc is corroded by sea water, gordaite, which is highly protective, is produced by the sulfate ions contained in the sea water, but the aqueous sodium chloride solution used in the technology of Reference 1 does not contain sulfate ions and does not produce gordaite. Thus, in order to accurately evaluate the performance of the zinc spraying coating, the test solution used was not the solution described in Reference 1, but the "new corrosion test solution (pH 5)" described in Reference 4.

Experimental Results 1

Experimental Results 1 of Experiment 1 are shown in the following Table 1.

TABLE 1

| | Sample A | Sample B | Sample C | Sample D | Sample D | Sample F | Sample G | Sample H |
|---|---|---|---|---|---|---|---|---|
| Amount of calcium sulfate added (wt %) | 0 | 1 | 2 | 4 | 8 | 16 | 24 | 32 |
| Red rust in sound area of spraying coating | Large | Middle | Small | None | None | None | Small | Large |
| Red rust in damaged area of spraying coating | Large | Middle | Small | None | None | None | Small | Small |

As shown in Table 1, white rust of zinc is deposited while the spraying coating (zinc layer) is present and zinc is being corroded, but red rust is generated when the spraying coating is worn out and the steel sheet, the material to be sprayed, starts to be corroded. Also, even in the damaged area of the spraying coating where the spraying coating has been artificially scratched, if the spraying coating (zinc layer) is present around the damaged area, the sacrificial corrosion protection and protective film properties of zinc work to prevent corrosion of the exposed steel material.

Compared with Sample A to which calcium sulfate had not been added, the generation of red rust in the damaged area of the spraying coating and the sound area of the spraying coating was significantly reduced in all samples to which calcium sulfate had been added. Especially, the results of samples in which calcium sulfate had been added to zinc powder such that the amount of calcium sulfate added was 2 to 24 wt % of the weight of zinc powder were good. Sample H, in which calcium sulfate had been added to zinc powder such that the amount of calcium sulfate added was 32 wt % of the weight of zinc powder, slightly reduced the generation of red rust in the damaged area of the spraying coating and in the sound area of the spraying coating, but red rust was generated more significantly than in Sample A especially at the edge part of the sample, except in the damaged area of the spraying coating.

The reason why the addition of calcium sulfate improved the corrosion protection is thought to be that the zinc ions released from zinc powder and the sodium ions, chloride ions, and sulfate ions contained in the test solution used for the combined cycle test (in the actual salt damaged environment, sea water) forms a protective film of gordaite [$NaZn_4(SO_4)(OH)_6Cl \cdot 6H_2O$], which is highly corrosion protective (see Reference 2).

In salt damaged areas where sea salt particles fly in, the sodium ions, chloride ions, and sulfate ions contained in sea water cause the production of this gordaite on the surface of zinc. The present inventors investigated the possibility of improving the corrosion protection of the zinc spraying coating by intentionally forming gordaite in a larger amount. In addition to gordaite, red zinc ore [zincite, ZnO], zinc flowers [hydrozincite, $Zn_5(CO_3)_2(OH)_6$], layered zinc hydroxide chloride [simonkolleite, $Zn_5(OH)_8Cl_2 \cdot H_2O$], and the like are known to be formed as major corrosion products of zinc.

Two of the above, layered zinc hydroxide chloride and gordaite, are corrosion products that are not produced in the absence of chloride ions. Corrosion products of zinc prepared by corroding zinc with artificial sea water were powdered in an agate mortar, and the ratio of the peak intensity of gordaite)(11.0°) to the peak intensity of layered zinc hydroxide chloride)(6.5°) (gordaite/layered zinc hydroxide chloride ratio) was determined by X-ray diffraction analysis (XRD analysis). The peak positions used were selected from those where there were no peaks of other corrosion products nearby.

For the corrosion products of zinc, a comparison was made between a sample that was prepared and then submitted to the XRD analysis as it was, and a sample that was prepared then washed with a large amount of pure water for a long period of time, and then submitted to the XRD analysis. As a result of this comparison, a peak of gordaite appeared in the sample without washing, and the gordaite/layered zinc hydroxide chloride ratio was about 1. In contrast, the peak of gordaite was very small in the washed sample, and the gordaite/layered zinc hydroxide chloride ratio was reduced to 0.1, about 1/10. From the above, it was found that gordaite is more soluble in water than layered zinc hydroxide chloride.

Based on the above results, the present inventors considered that the process of zinc corrosion by sea salt particles and deposition of gordaite and layered zinc hydroxide chloride is as follows.

In the test solution with corroded zinc (in the actual salt damaged environment, sea water/sea salt particles), in addition to zinc ions, sodium ions, chloride ions, sulfate ions, magnesium ions, and many other sea water-derived ions are present, but chloride ions are present in a larger amount than sulfate ions in sea water, and layered zinc hydroxide chloride is less soluble in water (≈lower solubility product) and is more likely to be deposited. Because of this, as the aqueous solution is dried and the concentration of the solution is increased, layered zinc hydroxide chloride begins to be deposited earlier. This deposition of layered zinc hydroxide chloride consumes chlorides in the solution, increasing the proportion of sulfate ions to chloride ions, and after the aqueous solution is further dried and concentrated, gordaite is finally deposited.

From the above, the present inventors thought that if sulfate ions are also supplied from sources other than sea water, the production proportion of gordaite is increased, the corrosion protection of zinc is improved, the corrosion rate of zinc is reduced, and the service life can be extended, and thus they decided to add a water-soluble sulfate salt to zinc for zinc spraying.

Normally, when a water-soluble salt is added to a metal, the added salt is ionized in water and becomes an ion, which increases the electrical conductivity of the water (reduces the electrical resistance). Therefore, a potential demerit is that it works in the direction of accelerating the progress of metal corrosion. Thus, until the present inventors experimented, it was unclear, when a water-soluble sulfate salt is added to zinc spraying, which of the merit of increased proportion of highly protective gordaite or the demerit of reduced solution resistance in corrosion reaction is greater. Accordingly, it has not been considered that the addition of sulfate salt to zinc spraying improves the corrosion protection, and this cannot be easily analogized.

It is also known that sulfate ions contained in sea water cause the formation of gordaite, which is a highly protective corrosion product of zinc (Reference 2). However, it is also not easily analogized that, by focusing on the solubility products of layered zinc hydroxide chloride and gordaite and by supplying sulfate ions separately from sea water, gordaite is intentionally deposited in a larger amount than usual at an early stage where only layered zinc hydroxide chloride is deposited and no gordaite is formed in normal (sea water only) conditions, thereby reducing the corrosion rate of the zinc spraying coating.

In addition, when the corrosion rate of zinc is reduced too much, firstly, the corrosion protective current does not flow to the steel material (iron) exposed in the damaged area of the zinc layer and the sacrificial corrosion protection does not work; and secondly, the supply of zinc ions to the damaged area of the zinc layer is reduced, zinc corrosion products are not formed to cover the damaged area of the zinc layer, and the protective film properties do not work either, thus reducing the corrosion protection.

As described above, it is not good to reduce the corrosion rate of zinc too much, and thus, a moderate corrosion rate is required. However, it has not been conventionally known, and cannot be easily estimated, that although the addition of a water-soluble sulfate salt results in a reduced corrosion rate of zinc compared to the conventional technology, the corrosion rate is sufficient to provide better corrosion protection for the steel material (iron) exposed in the damaged area of the zinc layer than in the case of no addition.

The chemical formula of gordaite is $NaZn_4(SO_4)(OH)_6Cl{\cdot}6H_2O$. Na and Cl are contained abundantly in sea water, and OH is also relatively abundant because the pH of sea water is weakly alkaline. Therefore, the sulfate salt used in embodiments of the present invention only needs to be dissolved in water and release sulfate ions, and thus, any water-soluble sulfate salt can be used. In particular, Reference 3 reports that calcium and magnesium salts are effective in suppressing the corrosion of zinc, and therefore, sulfate salts thereof are suitably used.

Note that, considering the influence on the environment and the availability at a relatively low cost, suitable examples of the sulfate salt to be used include potassium sulfate, sodium sulfate, magnesium sulfate, calcium sulfate, ferric sulfate, ferrous sulfate, lithium sulfate, calcium sulfate, and aluminum sulfate.

The edge part of the sample where zinc spraying has been performed has a thinner spraying coating (zinc layer) than other parts, and therefore, when calcium sulfate has been added into the spraying coating, calcium sulfate in the spraying coating is eventually released little by little, and the part where calcium sulfate used to be present becomes a void. Thus, if there is a part where calcium sulfate is unevenly present at the edge part of the sample where the spraying coating is thinly formed, red rust is likely to be generated. When the cross-section of the above sample was observed with an electron microscope, it was observed that the distribution of calcium sulfate was not uniform in the spraying coating, which thus suggests that better results can be obtained with the same amount of calcium sulfate added by devising the particle diameter of calcium sulfate, mixing method with zinc powder, and the like.

Here, calcium sulfate was added to zinc powder such that the amount of calcium sulfate added was 1 to 32 wt % of the weight of zinc powder, which means that, in terms of molar amount, 0.006 to 0.186 mol of calcium sulfate was added to 100 g of the weight of zinc powder. Therefore, when adding a sulfate salt other than calcium sulfate, it may be added such that the amount thereof to be added is 0.006 to 0.186 mol based on 100 g of the weight of zinc powder.

Also, the results are particularly good for samples in which calcium sulfate (dihydrate) was added to zinc powder such that the amount thereof was 2 to 24 wt % of the weight of zinc powder, and the addition of calcium sulfate in the range of 0.011 to 0.14 mol based on 100 g of the weight of zinc powder is particularly desirable.

Experiment 2

Next, Experiment 2 will be described. Experiment 2 examined the effect of using a sulfate salt whose water solubility is lower than that of calcium sulfate.

The concentration of a saturated aqueous solution of calcium sulfate is 0.014 mol/L at 20° C., and therefore, when water is in contact with a spraying coating (zinc layer) containing calcium sulfate for a long period of time, the concentration of sulfate ions and calcium ions becomes up to 0.014 mol/L. To this water, sodium ions, chloride ions, and the like derived from sea salt are also added, and when the water is dried from this state, gordaite is deposited. As a result, the corrosion protection is thought to be improved.

Then, using an aqueous solution obtained by dissolving calcium sulfate in a 7 g/L aqueous solution of sodium chloride such that the concentration of sulfate ions and calcium ions is zero, or about 1/16 (0.0009 mol/L), 1/8 (0.0017 mol/L), 1/4 (0.0035 mol/L), or 1/2 (0.007 mol/L) of the concentration of the saturated aqueous calcium sulfate solution (0.014 mol/L), the NIT type combined cycle test described in Reference 1 was performed for 240 hours to corrode the zinc plate and its amount of corrosion was measured.

Experimental Results 2

Experimental Results 2 of Experiment 2 are shown in the following Table 2. When the amount of zinc corrosion was defined as 100 in the case where the concentration of calcium sulfate was zero, there was no significant change in the amount of corrosion at a calcium sulfate concentration of 0.0009 mol/L, but it was found that the amount of corrosion was significantly reduced at 0.0017 mol/L.

TABLE 2

| | Calcium sulfate concentration inaqueous sodium chloride solution | | | | |
|---|---|---|---|---|---|
| | 0 mol/L | 0.0009 mol/L | 0.0017 mol/L | 0.0035 mol/L | 0.007 mol/L |
| Amount of zinc corrosion (normalized assuming that sample of 0 mol/L is 100) | 100 | 93 | 69 | 43 | 24 |

When the concentration of sulfate ions was 0.0017 mol/L or more (about 1/8 or more of the saturated concentration of calcium sulfate), the corrosion rate of zinc was greatly reduced. From the above results, it was found that the solubility of sulfate salt in water may be lower than that of calcium sulfate, and if a sulfate salt whose solubility in water is higher than 0.0017 mol/L at normal temperature exists, when a paint having this sulfate salt added is applied to a paint surface that is mainly composed of zinc, the effect of improved corrosion protection can be obtained compared to the case where the sulfate salt is not added.

The results of Experiment 2 suggest that sulfate salts whose water solubility is lower than 1/8 of that of calcium sulfate at normal temperature (poorly soluble) cannot supply sufficient sulfate ions. Since the solubility of calcium sulfate in water is 0.24 g/100 $cm^3$ (20° C., anhydrous) and 0.21 g/100 $cm^3$ (20° C., dihydrate), any sulfate salt whose solubility in water is 1/8 or more of that of calcium sulfate is suitably utilized.

Note that, since what is important is the concentration of sulfate ions, the value here that the water solubility is 1/8 or more of that of calcium sulfate is not based on the weight of sulfate salt dissolved in a unit volume of water, but on the molar amount. Accordingly, as used herein, the sulfate salt whose solubility in water is 1/8 or more of that of calcium sulfate dihydrate (molecular weight of 172.17), 0.24 g/100 $cm^3$ (2.4 g/L), refers to a sulfate salt exhibiting a water solubility of 1/8 or more of 0.014 mol/L=2.4 g/L÷172.17 at normal temperature, that is, 0.0017 mol/L or more.

Since the solubility of calcium sulfate in water is as low as 2.4 g/L at 20° C., it can supply sulfate ions more gradually and over a longer period of time than sulfate salts with a higher solubility in water. As can be seen from the Experimental Results 2 mentioned above, sulfate salts whose solubility in water is significantly lower than that of calcium sulfate (poorly soluble) (specifically, sulfate salts whose solubility is less than 1/8 of that of calcium sulfate) are not suited for applications of the present invention because they cannot supply sufficient sulfate ions.

In addition, in embodiments of the present invention, any water-soluble sulfate salt can be suitably utilized, but it can be easily analogized that not only any one type of sulfate salt to be added, but also a combination of multiple sulfate salts can be added.

For example, sodium ions are abundantly supplied in salt damaged areas caused by sea salt, but in the case of salt damaged areas caused by snow melting agents, since the snow melting agents used are often calcium chloride or magnesium chloride and do not contain sodium, when only calcium sulfate is added to zinc spraying, sodium ions necessary for the production of gordaite [$NaZn_4(SO_4)(OH)_6Cl \cdot 6H_2O$] are not supplied and the corrosion protection is not improved. In order to prevent this, a salt that releases sodium ions may be added. However, since sodium sulfate has a high solubility in water, when sodium sulfate is added alone, the part where the sulfate salt has been added becomes a void in a short period of time.

For solving this problem, it can be easily analogized that mixed powder of sodium sulfate and calcium sulfate or a sulfate salt that can release multiple cations, such as glauberite [$Na_2Ca(SO_4)_2$], may be used to reduce the proportion of sodium sulfate. Alternatively, it can also be easily analogized that mixed powder of a sulfate salt not containing sodium but having a low solubility in water (for example, calcium sulfate) and a sodium salt having a low solubility in water other than sulfate salts may be used. In addition, it can also be easily analogized that if sodium sulfate placed in a capsule having a moderate solubility in water is mixed with calcium sulfate powder and used, the sodium sulfate placed in the capsule can supply sodium ions little by little and have a longer lasting effect compared to the case where the sodium sulfate is mixed as it is in the form of powder.

Also, although the hydrate of sulfate salt (calcium sulfate dihydrate) was utilized in embodiments of the present invention, it can be easily analogized that, as the sulfate salt to be added, any anhydride may be used or any sulfate salt with a different value of n in n-hydrate may be used, as long as it can be dissolved in water to produce sulfate ions.

Moreover, as for the zinc used in zinc spraying, a zinc alloy with a small amount of aluminum or magnesium added to zinc may be used for the purpose of improving the corrosion resistance, but in such an alloy mainly composed of zinc, zinc ions are released by corrosion, and therefore, it can be easily analogized that the same effect can be obtained by using embodiments of the present invention.

Also, in the case of using an arc spraying device, since powder cannot be used as the spraying material, arc spraying may be performed using a spraying material prepared by dispersing sulfate salt powder in zinc that has been melted at a high temperature and then cooling the mixture.

As described above, in embodiments of the present invention, a sulfate salt whose solubility in water is 1/8 or more of the solubility of calcium sulfate is added to a zinc spraying material such that the zinc spraying material comprises a zinc material containing zinc and the sulfate salt, and therefore, the corrosion rate of zinc can be reduced and the service life of the coating by zinc spraying can be extended without increasing the cost. In addition to reducing the corrosion of zinc, released zinc ions also form gordaite in the damaged area of the spraying coating (zinc layer), thereby suppressing the corrosion of the exposed material to be sprayed (mainly steel).

Compared to the conventionally used zinc spraying, the corrosion rate of the spraying coating (zinc layer) is slower, and therefore, this zinc spraying containing the sulfate salt provides a longer service life and higher corrosion protection. As a result, maintenance intervals can be elongated and maintenance costs can be reduced.

Note that the present invention is not limited to the embodiment described above, and it is obvious that those having ordinary skill in the art can make many modifications and combinations without departing from the technical idea of the present invention.

[Reference 1] T. Miwa, Y. Takeshita, and A. Ishii, "Technical report—Tosokoban wo mochiita kakushu sokushinfushokushiken/okugaibakuroshiken niyoru fushokukyodo no hikaku (in Japanese) (Comparison of corrosion behaviors by various accelerated corrosion tests or field exposure tests using coated steel plates)", RUST PREVENTION & CONTROL JAPAN, 61, 12, p. 449-455, 2017.

[Reference 2] N. S. Azmat et al., "Corrosion of Zn under acidified marine droplets", Corrosion Science, vol. 53, pp. 1604-1615, 2011.

[Reference 3] Aen mekkiko kozobutsu kenkyukai (in Japanese) (Research Group on Galvanized Steel Structures), "Yoyu aenmekki no taishokusei, 6. suichu no taishokusei (in Japanese) (Corrosion resistance of hot dip galvanizing, 6. corrosion resistance in water)", [retrieved on Oct. 30, 2019], (https://jlzda.gr.jp/mekki/pdf/youyuu.pdf).

[Reference 4] T. Miwa, A. Ishii, and H. Koizumi, "Engaikankyo deno aen no taikifushoku wo yori seikaku ni saigensuru sokushinfushokushikenyoeki no kento (in Japanese) (Investigation of accelerated corrosion test solutions to more accurately reproduce atmospheric corrosion of zinc in salt damaged environments)", Proceedings of JSCE Materials and Environments 2018, B-308, pp. 193-196, 2018.

REFERENCE SIGNS LIST

101 Spouting unit
102 First supplying unit
103 Second supplying unit
104 Mixing unit.

The invention claimed is:

1. A method for producing a zinc spraying material, the method comprising:

a first step of melting a zinc material comprising zinc;

a second step of dispersing a sulfate salt into the zinc material that has been melted, wherein the sulfate salt has a solubility in water that is ⅛ or more than a solubility of calcium sulfate, wherein a content of the sulfate salt is 0.006 to 0.14 mol based on 100 g of a content of the zinc material; and a third step of cooling and solidifying the zinc material in which the sulfate salt is dispersed.

2. The method according to claim 1, wherein the sulfate salt is at least one of potassium sulfate, sodium sulfate, magnesium sulfate, calcium sulfate, ferric sulfate, ferrous sulfate, lithium sulfate, calcium sulfate, and aluminum sulfate.

3. The method according to claim 1, wherein the zinc material is a zinc alloy containing zinc as a main component and at least one metal selected from aluminum and magnesium.

* * * * *